United States Patent [19]

Lehtinen et al.

[11] Patent Number: 4,622,758

[45] Date of Patent: Nov. 18, 1986

[54] METHOD OF AND A DEVICE FOR DRYING A PAPER WEB OR THE LIKE

[75] Inventors: Jukka Lehtinen; Olli-Pekka Sorma, both of Tampere, Finland

[73] Assignee: Oy Tampella Ab, Tampere, Finland

[21] Appl. No.: 774,909

[22] Filed: Sep. 11, 1985

[30] Foreign Application Priority Data

Oct. 9, 1984 [FI] Finland ..... 843958

[51] Int. Cl.[4] ..... F26B 3/24

[52] U.S. Cl. ..... 34/13; 34/41; 34/116; 34/119; 34/124; 34/75

[58] Field of Search ..... 34/39, 41, 9, 119, 124, 34/111, 116, 123, 95, 73, 13, 75

[56] References Cited

U.S. PATENT DOCUMENTS

| | | | |
|---|---|---|---|
| 3,354,035 | 11/1967 | Gottwald et al. | 34/41 |
| 3,925,906 | 12/1975 | Change et al. | 34/123 |
| 4,050,510 | 9/1977 | Theysohn | 34/124 |
| 4,461,095 | 7/1984 | Lehtinen | 34/124 |

*Primary Examiner*—Larry I. Schwartz
*Attorney, Agent, or Firm*—Ladas & Parry

[57] ABSTRACT

The invention relates to a method of and a device for drying a paper web or the like, in which method a web (8) and a wire or felt (9) supporting it are subjected to a deairing treatment. The wet web (8) and the wire or felt (9) thus deaired the thereafter passed between two displaceable airtight surfaces of high heat conducting properties, between which surfaces the web (8) is enclosed in the drying zone over the whole width thereof. The surface making contact with the web (8) is heated and the surface making contact with the wire or felt (9) is cooled by liquid in order to condense the water evaporated from the web (8) into the wire or felt (9). The wire or felt (9) is separated from the dried web (8) after said surfaces and the water condensated is removed therefrom. In a drying process the surface making contact with the wire or felt (9) is formed by the outer surface of a cooled rotating metal cylinder (2). The surface making contact with the web (8), in turn, is a metal band (6) displaceable around the outer surface of said cooled cylinder (2) stationarily with respect to said surface of the cylinder (2) and preheated outside the drying zone, which band presses the web and the permeable wire or felt making contact with the cylinder surface against the outer surface of said cylinder.

10 Claims, 1 Drawing Figure

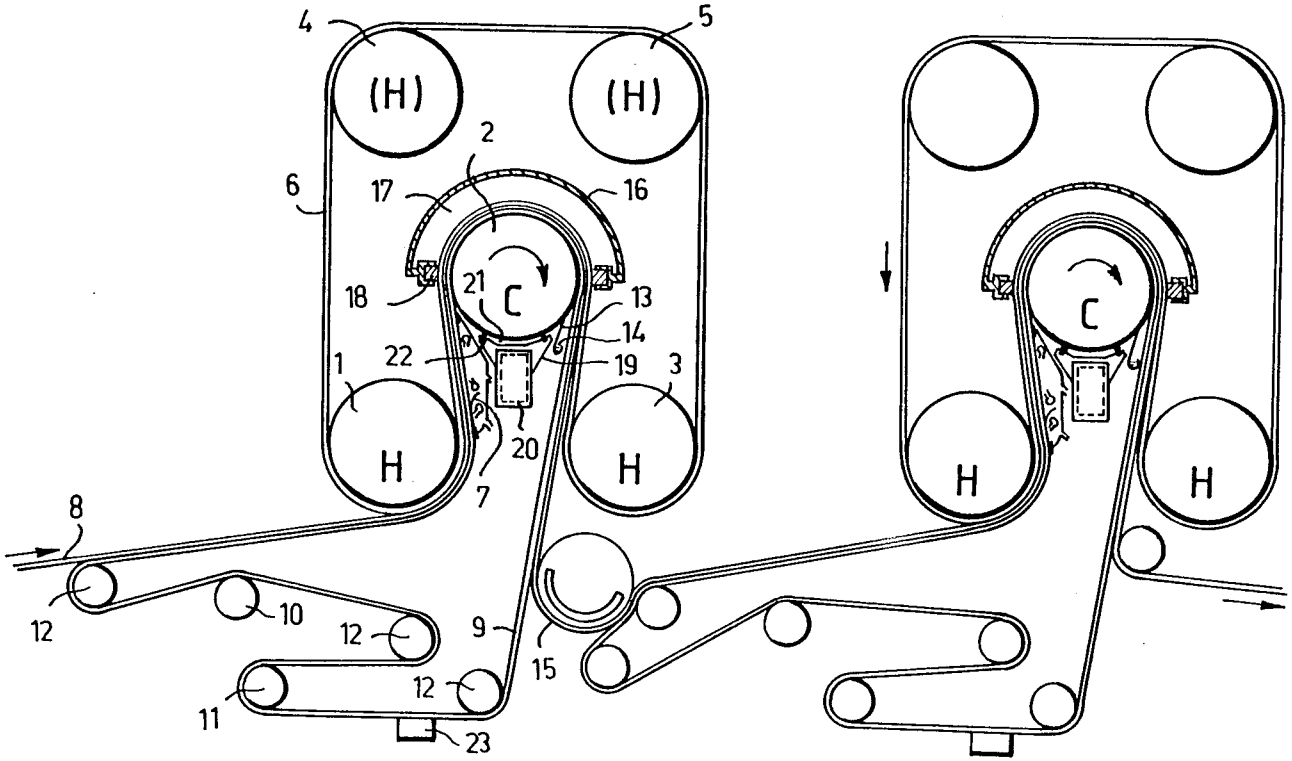
H
H
C
H
(H)
(H)
H
C
1
2
3
4
5
6
7
8
9
10
11
12
12
12
13
14
15
16
17
18
19
20
21
22
23

METHOD OF AND A DEVICE FOR DRYING A PAPER WEB OR THE LIKE

The invention relates to a method of drying a paper web or the like, in which method a web and a wire or felt supporting said web are subjected to a deairing treatment and the web and the wire or felt thus deaired are thereafter passed between two displaceable airtight surfaces of high heat conducting properties, said web being enclosed between said surfaces in the drying zone over the entire width thereof, and the surface making contact with the wire or felt is cooled by liquid in order to condensate the water evaporated from the web by means of a heated surface making contact with the surface of said web, whereby said water is condensated into the wire or felt, which wire or felt is separated from the web after said surfaces and the water condensated is removed therefrom, and further, to a device for applying said method.

Such a method and the devices developed for the application thereof are described in, e.g., Finnish Patent Specifications Nos. 54,514 and 61,537. In short, said patent specifications describe a drying process, i.e. a so called Convac drying process, which is carried out in a space between a heated and a cooled surface, said space being as airless as possible.

Finnish Patent Specification No. 54,514 deals with a drying process in which the temperature of the heated surface is approx. 100° C., the temperature of the cooled surface, on which the steam evaporated from the web to be dried is condensated, being relatively low, i.e. typically below 40° C.

Finnish Patent Specification No. 61,537, in turn, deals with press drying processes and conditions. As far as paper or cardboard is concerned, the temperature of the moist web typically exceeds 100° C. throughout the drying operation, and the simultaneous press effect exerted in a direction perpendicular to the surface of the web is also high, typically more than 0.3 MPa. According to Finnish Patent Specification No. 61,537, such web drying conditions are obtained by maintaining the temperature of the heated band high, typically up to 180° C., whereby also the temperature of the cooled surface is kept sufficiently high, typically ranging from 80° to 150° C. At the same time, both the heated and cooled surface are subjected to a suitable loading from the outside, whereby the web is exposed to a desired press effect.

In both said patent specifications, the method is carried out in practice in such a manner that both the heated and the cooled surface are metal bands moving in the direction of the movement of the web at the speed of the web. Between said metal bands, the web to be dried is positioned against the heated band and a felt, wire or some other mat permeable to steam against the cooled band, the other side of said mat thus facing the web to be dried. A stationary box containing pressurized saturated steam is positioned outside the heated metal band, said box being open towards the moving metal band in such a manner that the steam is in direct contact with the metal band or the condensate forming thereon.

A box exactly similar to that described above in connection with the heated band is provided outside the cooled metal band. The box of the cooled band, however, contains water, the pressure of which equals to the pressure of the steam in the box of the heated band. The temperature of the water, on the contrary, is several tens of degrees lower than that of the steam.

Finnish Patent Specification No. 61,537 further discloses a solution in which several drying zones are provided one after another. Thus the temperature of the cooled band can be different in each subsequent drying zone.

Besides the above-mentioned drying zone, which comprises two parallel metal bands, Finnish Patent Specification No. 59,636, for instance, discloses a structure in which the heated surface is formed by the outer of a metal cylinder rotating around the axis thereof. The cooled surface is thereby a metal band, or some other band impermeable to gas, extending farthest on the cylinder. Correspondingly, the press drying process with its multi-zone alternatives such as described in Finnish Patent Specification No. 61,537 is also carried out on a cylinder.

Although the drying rates in the afore-described devices are very high, typically even more than tenfold in comparison with the drying rates of conventional drying cylinders of paper machines, it is clear that modern rapid paper or cardboard machines would require long drying zones, typically some tens of meters in the entire drying section, also in connection with these drying methods. This kind of devices are, of course, expensive and can generally be mounted only in quite new machines.

It is to be mentioned that numerous laboratory tests have shown that, with regard to raising the strength values of a paper or cardboard web, the most efficient way is press drying at the wet end of the drying process in particular. Accordingly, if only a part of the entire drying distance can be dried by pressing, it is most advantageous to position the press drying step at the wet end of the drying section.

It is clear that one cylinder or some cylinders of a conventional drying section could be modified to act as press driers of the type illustrated in FIGS. 1 and 2 of Finnish Patent Specification No. 61,537. Several auxiliary devices and equipments would become necessary, but, on the contrary, the drying cylinder in question as well as the frames, operations and steam/condensate systems thereof could be used almost as such also in the described press drying arrangement.

However, this solution would be practical and economical on by in case some existing MG cylinder or some other Yankee cylinder could be modified for said press drying process. The biggest difficulty would be the high heat resistance of the mantle of drying cylinders made of cast iron. In the press drying according to Finnish Patent Specification No. 61,537, the heat flux on the heated surface can, actually, be extremely high, momentaneously even 200 $kW/m^2$. It is clear that such heat flux values are not obtained on the mantle of a cast iron cylinder; if a cast iron cylinder were used in the described press drying process as the heated surface, it would form a bottleneck greatly slowing down the drying rate.

Because the MG cylinders are usually very large, typically with the diameter exceeding 3 meters, they allow a press drying zone to be provided which is so long that efficient drying is possible in spite of the high heat resistance of the cast iron mantle. With a drying cylinder of the usual size, i.e. 1.5 or 1.8 m in diameter, the total amount of dying would, however, remain so low that such an arrangement would hardly be worthwhile.

The object of the invention is to provide a drying method and a device which enable a press drying process disclosed in Finnish Patent Specification No. 61,537, e.g., to be carried out at least at the wet end of a drying section in a paper or cardboard machine in such a manner that already existing devices and constructions of a conventional drying section could be utilized as extensively as possible. In this way, the required capital costs could be minimized.

This is achieved by means of the method according to the invention, which is characterized in that the surface making contact with the wire or felt is the outer surface of a rotating metal cylinder provided with internal cooling, and that the surface making contact with the web is a metal band displaceable around the outer surface of the cooled cylinder stationarily with respect to said outer cylinder surface and preheated outside of the drying zone, which band is pressed from the outside thereof against the outer surface of the web positioned on the outer surface of the cooled cylinder, simultaneously pressing the web and the permeable wire or felt making contact with the cylinder surface against the outer surface of the cylinder.

The device according to the invention, in turn, is characterized in that the surface making contact with the wire or felt is formed by the outer surface of a rotating metal cylinder provided with internal cooling, and that the surface making contact with the web is formed by a metal band displaceable around the outer surface of the cooled cylinder stationarily with respect to said outer cylinder surface and preheated outside of the drying zone, which band is pressed against the outer surface of the web and the wire or felt positioned on the cooled cylinder by means of an air-pressure chamber provided outermost therein.

When compared with the solution according to Finnish Patent Specification No. 61,537, e.g., an advantage of the invention is that the heat required for the evaporation of the moist contained in the web must only go through a relatively thin metal band or a portion thereof in order to reach the web itself. The thickness of the band typically ranges from 1.0 to 1.5 mm. Thus the heat transmission resistance occuring in transferring heat into the web is extremely low.

It is clear that, in the drying process in question, the amount of heat transferred onto the cooled surface and through it and further away therefrom almost precisely equals to the amount of heat transferred (on the same heat flux) through the heated surface into the web. So it would be natural to assume that this kind of high heat flux can be passed through neither as the drying cylinder acts as the cooled surface nor as it acts as the heated surface. However, the situation is now quite different with respect to the drying rate and certain qualitative matters connected with the drying process. Finnish Patent Specification No. 59,439 proves how little the drying rate is influenced by the temperature of the cooled surface in this kind of Convac drying process, if only the temperature of the cooled surface does not raise too close to that of the heated surface. Typically, it is essential that the former temperature is more than 40° C. lower than the latter. Finnish Patent Specification No. 59,439 also briefly sets forth the reason for this.

In connection with the present invention, this implies that if the temperature of the heated surface, i.e. the steel band extending outermost on the cylinder, is, for instance, approx. 140° C. and a newsprint paper of 42 g/m$^2$ and with a dry solids content of approx. 45% is being dried, the cylinder roughly operates as follows. The drying flux from the web is approx. 400 kg/(h.m$^2$) and, accordingly, the heat flux through the mantle of the drying cylinder approx. 140 kW/m$^2$, taking into consideration that the drying zone on the cylinder only extends over approx. 60% of the entire periphery of the cylinder. If the convective heat transfer coefficient from the internal cooling water of the cylinder onto the inner surface of the cylinder is 10,000 W/(m$^2$.°C.), the temperature of the inner cylinder surface is approx. 14° C. above the temperature of the water. If the thickness of the cylinder mantle is 25 mm, and the coefficient of heat conduction of the cast iron of the mantle 55 W/(m.°C.), the temperature of the outer surface of the cylinder is 63° C. above the temperature of the inner surface. Further, if the temperature of the cooling water inside the cylinder is approx. 15° C., the temperature of the outer surface of the cylinder is $(15+14+63)°C.=92°$ C.

In view of the afore-mentioned, the drying rate in this particular case would be only a few percent (according to the most recent results maybe 10–20%) below a drying rate which would occur if the temperature of the heated surface were still 140° C., the temperature of the cooled surface being 20° C.

In view of the development of the qualitative properties of the web to be dried, it could be of great advantage to almost all paper or cardboard machine webs if the temperature of the cooled surface, in this particular case that of the outer surface of the drying cylinder, would be as high as 92° C., provided that the web would be simultaneously exposed to a fairly high pressure (typically above 0.3 mPa) in the direction Z. These effects, and their reasons, are described in Finnish Patent Specification No. 61,537. The most important thing with respect to the qualitative properties is that the temperature is above 100° C. (preferably above 120° C. or even more) all over the web during the drying process, the web being simultaneously influenced by said pressure in the direction Z.

If the surface temperature of the drying cylinder were 92° C. and the drying rate 400 kg/(h.m$^2$), the temperature of the web side facing the drying cylinder would probably be $>100°$ C., depending on the permeability of the felt, wire or any other permeable mat provided between the drying cylinder and the web.

A further advantage of the invention is that it can be highly advantageously applied to existing paper machines, wherefore the introducing costs are extremely low.

The invention will be more closely described in the following by means of the attached drawing which illustrates the principal features of two drying groups of a paper machine, which drying groups are modified according to the invention to operate as Convac driers.

In the FIGURE, three lowest cylinders 1, 2 and 3 of both drying groups have their original locations. For clarity's sake, the left-hand drying group only is provided with reference numerals, the right-hand group being fully identical with the left-hand one. Two uppermost cylinders 4 and 5, on the contrary, have been added and it has naturally been necessary to provide frames and bearings (not shown in the FIGURE) for said cylinders. A preheated band 6 of steel extends around all five cylinders. The cylinder positioned in the middle is the proper Convac drying cylinder. A deairing unit 7 removes as much air as possible from a web 8 and from a plastic wire or felt 9. If required, several wires can be provided, whereby the one positioned nearest the web is as fine as possible. The deairing is effected either by blowing or sucking steam through the wires or the felt or by sucking air from a deairing chamber by means of a suction pump, or by combining these two processes. In the FIGURE, the plastic wire 9 represents one or more wires or felts, which can also be used simultaneously as a mixed combination. The wire 9 is guided by a guide 10 and tightened by a tightener 11. The wire circulation also comprises several wire conducting rolls 12. In the Convac zone, the water evaporated from the web is partly condensated on the surface of the cylinder 2, partly on that side of the wire 9 which faces the cylinder. The condensate is scraped away from the cylinder surface by means of a scraper 13 and the condensate water thus removed from the cylinder 2 is discharged through a chute 14. The water condensated on the wire 9 is removed by means of a suction box 23. After the drying zone, the web 8 is raised up from the wire 9 by means of a suction roll 15, e.g., and is further displaced therefrom by means of known methods into a subsequent corresponding drying group. In order to effect preheating of the band 6, the two lowest cylinders 1, 3 are internally heated by steam with conventional methods. The Convac cylinder 2 is provided with an internal water cooling by means of known water circulation arrangements, and the two uppermost cylinders 4, 5 can also, if necessary, be provided with internal steam heating. The marking C in the FIGURE designates a water cooled cylinder and the marking H, in turn, a steam heated cylinder. The marking H designates potential steam heating, as stated above. An air pressure chamber 16 is provided above the Convac drying zone, said chamber containing pressurized air 17. The edges of the chamber 16 are provided with sealings 18, against which the steel band is displaceable. A counter force shoe 19 is provided on the opposite side of the cylinder 2, said shoe comprising a supporting bar 20, an air-pressure chamber 21 and slide sealings 22 positioned against the cylinder 2.

The solution of the FIGURE is to be understood solely as an example which can be modified in various ways. Some possible preferred modifications of the invention are described in the following and, besides, some numerical examples are given to illustrate the idea of the invention.

As appears from the example of the FIGURE, one essential feature of the invention is that the steel band 6 forming the heated surface is preheated outside of the drying zone to a temperature sufficiently high to prevent the temperature of the band 6 from dropping too low within the drying zone. It should be remembered here that a steel band having a thickness of 1.2 mm, e.g., has a relatively high specific heat capacity. The drying situation described above can be mentioned as an example in this connection, i.e. the situation in which a newsprint paper of 42 g/m$^2$ and a having a dry solids content of approx. 45% is dried, the temperature of the heated metal band 6 being approx. 140° C. If the diameter of the cylinder 2 is 1.8 m and 60% of the outer surface is included in the drying zone and if the speed of machine is 15 m/s, the web 8 is passed through the drying zone on the cylinder in 0.226 seconds. The drying rate being 400 kg/(h.m$^2$), 25.1 g/m$^2$ water is thereby evaporated from the web 8. Because the density of the steel band 6 is 7,800 kg/m$^3$ and the specific heat 0.46 kJ(kg.°C.) and because the latent heat required for the evaporation of the moist contained in the web 8 is approx. 2,100 kJ/kg, the temperature of the steel band 6 drops by 12.3° C. when the steel band is passed through the drying zone. Accordingly, if the steel band 6 reaches the drying zone at a temperature of 146.2° C., it leaves the zone at a temperature of 133.9° C. It is here assumed that the heat from the steel band is used only for the evaporation of the moist contained in the web 8.

According to the above example, a steel band having a thickness of 1.2 mm has a sufficient heat capacity to act as the heated surface of the drying zone on the cylinder 2. The evaporated flux used in the example, i.e. 400 kg/(h.m$^2$), is, actually, one of the highest encountered in practice.

The preheating carried out outside of the drying zone can be effected in several different ways. In the solution of the FIGURE, said preheating is carried out by passing the metal band 6 over a few conventional drying cylinders 1, 3, 4, 5 which are provided with existing steam and condensate systems. The metal band (steel band) 6 is thereby in direct contact with the surface of said cylinders over a distance covering about 25–60% of the periphery of each cylinder 1, 3, 4, 5.

This kind of arrangement self-evidently requires that a low heat resistance is maintained between the outer surface of the cylinder 1, 3, 4, 5 and the steel band 6. If it is assumed that the roughness of the surface of the cylinder 1, 3, 4, 5 is $R_a$ 0.4–0.6 μm and that of the steel band $R_a$ 0.2–0.3 μm, it can be taken as granted that the thickness of the air layer between said surfaces is not approximately greater than 3 μm. If it is further assumed that all heat from the cylinder 1, 3, 4, 5 to the steel band 6 is transferred through this kind of air layer (i.e. no heat is transferred through metal-metal contact points), the heat transfer coefficient from the cylinder to the metal band is approx. 11,700 W/(m$^2$.°C.) This is almost ten times as high as the heat transfer coefficient from the internal steam of the cylinder to the surface thereof (typically about 1,400 W/(m$^2$.°C.). So, if the contact distance of the steel band on each cylinder is reasonably long, only the transmission of heat from inside the cylinders to the surfaces thereof is worth paying attention to in rough calculations concerning heating of the steel band.

It can be proved by calculations that, with the above values and the temperature of the internal steam of the drying cylinders 1, 3, 4, 5 being 170° C., heating of the steel band 6 from 133.9° C. to 146.2° C. requires 18.9 meters of the outer periphery of the drying cylinders. This is not the total length of the periphery portions making direct contact with the steel band 6 but the total length of the peripheries of the drying cylinders 1, 3, 4, 5 on which said steel band 6 extends over a reasonable distance. Accordingly, if the diameter of the cylinders 1, 3, 4, 5 is 1.8 m and the periphery of one cylinder thus 5.7 m, four such cylinders are required to obtain the required total length, i.e. 18.9 m.

The example described above dealt with a drying process at the wet end of the drying section, at which end the drying rate is particularly high. It can be easily proved that two drying cylinders would suffice in the central portions or at the dry end of the drying section in order to preheat the steel band 6 to a desired temperature prior to a drying zone of the type described above, the steel band 6 acting as the heated surface in said zone.

The cylinders 1, 3, 4, 5 used for the heating of the steel band can be drying cylinders of a conventional drying section which have conventional locations and operations as well as conventional steam and condensate systems, but additional cylinders, too, can be used, if required.

The preheating of the steel band 6 by means of a steam at a high pressure can also be carried out with some other kind of heating cylinders than conventional drying cylinders of a paper machine. The heat resistance of this kind of cylinder from the internal steam to the outer surface should be low in comparison with a drying cylinder of a paper machine. Because the outer surface of this kind of cylinder having a low heat resistance must be relatively smooth merely over the biggest portion of the total area, but not all over the surface, this kind of cylinder, 4 and 5, for instance, could be constructed so that the mantle is formed by metal tubes of a low heat resistance which extend close against each other in the direction of the axis of the cylinder and inside which steam and condensate flow. Said tubes should be such in shape that the contact surfaces of adjacent tubes were planar, whereby the outer surface of the cylinder could be machined round so that the surface between two neighbouring tubes would be seen on the outer surface only as an extremely narrow slit. In addition, it is clear that all said cylinders 1, 3, 4, 5 can be, if necessary, manufactured in a manner described above.

Alternatively, the steel band 6 can be heated by means of some other inexpensive heat source. It is possible to heat the band by means of the combustion products of some suitable fuel. A third alternative according to the invention is to preheat said steel band 6 by condensating waste steam or the like thereon. Naturally, the condensate must be removed from the band 6 before of the drying zone.

Said heating of the band 6 by means of combustion products can be carried out e.g. in a stationary box (not shown in the FIGURE) which is open towards either one or both sides of the moving band. Sealings are thereby needed to ensure that as little gas as possible is passed through the slits between the edges of the box and the band. Hot combustion products can be introduced into the box by known methods through a channel and the cooled combustion products can be correspondingly discharged from the box through another channel.

If the band 6 is preheated by means of steam, the arrangement would, with respect to the box, the sealings and the inlet channel, be rougly similar to that described above in connection with the use of combustion products. The resulting condensate should now, however, be scraped away from the surface(s) of the band by means of a scraper so as to be further passed away from the box through a suitable channel or tube.

When some group in a conventional drying section is modified for a Convac drying process, the drying wire(s), the idler rolls thereof, the pocket ventilations and probably some drying cylinders should be removed. The steel band 6 with its guides and tighteners must be added to the drying group. The steel band 6 does not usually require an operation machinery of its own, for the movement of the cylinders draws the band therewith. Further, a deairing equipment 7 must be provided in the vicinity of the cylinder 2 chosen to act as a Convac cylinder, said equipment being intended to remove air from the web 8 and from the wires or the felt 9 which are displaceable between said web 8 and the cooled cylinder. Besides the wires or the felt 9 just mentioned, also idler rolls thereof, quides and tighteners 10, 11, 12 are required. Further, means required for the internal water cooling of said Convac cylinder 2 become necessary. In most cases, a stationary air-pressure chamber 16 opening towards the moving steel band 6 beside the drying zone has to be provided outside of said Convac cylinder 2 and the heated steel band 6. The steel band 6 thus slides against the sealings 18 provided on the edges of the pressure chamber. If extremely high pressures are used in said pressure chamber 16, a counter force shoe or some other counter force device must be constructed on the opposite side of the cylinder 2, on which side there are no bands extending on the outer cylinder surface, in order to prevent excessive increase in the net force exerted on the bearings of the cylinder 2. Finally, two further cylinders 4, 5, e.g., with the frames thereof must be positioned in the neighbourhood of each Convac cylinder 2. These would operate as idler rolls of the steel band 6. Said additional cylinders 4, 5 should possibly be heated internally by steam at the wet end of the drying section, whereby said cylinders should also be provided with conventional steam and conventional steam and condensate systems.

The example described above and the applications thereof are not to be understood as restrictions on the invention, but the invention can be modified within the scope of the claims in various ways. Accordingly, the number of subsequent drying groups is by no means limited to those two illustrated in the FIGURE but other solutions are as well possible, etc.

We claim:

1. Method of drying a paper web or the like, in which method a web (8) and a wire or felt (9) supporting said web are subjected to a deairing treatment and the web (8) and the wire or felt (9) thus deaired are thereafter passed between two displaceable airtight surfaces of high heat conducting properties, said web (8) being enclosed between said surfaces in the drying zone over the entire width thereof, and the surface making contact with the wire or felt (9) is cooled by liquid in order to condensate the water evaporated from the web (8) by means of a heated surface making contact with the surface of said web, whereby said water is condensated into the wire or felt (9), which wire or felt (9) is separated from the web (8) after said surfaces and the water condensated is removed therefrom, characterized in that the surface making contact with the wire or felt (9) is the outer surface of a rotating metal cylinder (2) provided with internal cooling, and that the surface making contact with the web (8) is a metal band (6) displaceable around the outer surface of the cooled cylinder (2) stationarily with respect to said outer cylinder surface and preheated outside of the drying zone, which band is pressed from the outside thereof against the outer surface of the web positioned on the outer surface of the cooled cylinder (2), simultaneously pressing the web and the permeable wire or felt making contact with the cylinder surface against the outer surface of the cylinder.

2. Method according to claim 1, wherein said metal band (6) is preheated by passing it around at least one internally heated cylinder (1, 3, 4, 5) having a metal mantle.

3. Method according to claim 1, wherein said metal band (6) is preheated by heating it by means of the combustion gases of a fuel.

4. Method according to claim 1, wherein said metal band (6) is preheated by condensating steam thereon and by removing the condensate from the surface of the band prior to the beginning of the drying zone.

5. Method according to claim 1, wherein said metal band (6) is pressed towards the outer surface of the cooled cylinder (2) by means of compressed air.

6. Method according to claim 1, wherein the cooled cylinder (2) is formed by providing a drying cylinder (2) of a conventional cylinder drying section in a paper or cardboard machine with a water cooling.

7. Method according to claim 1, wherein said metal band (6) is preheated by means of some drying cylinders (1, 3) of a conventional drying section in a paper or cardboard machine.

8. Device for drying a paper web or the like, said device comprising a wire or felt (9) for transporting a web (8) to be dried, a deairing unit (7) acting on the web (8) and the wire or felt (9), two displaceable surfaces of high heat conducting properties, said surfaces being, in that portion of their path of movement which forms the drying zone, displaced in parallel with each other and in the same direction on opposite sides of the web (8) to be dried and the wire or felt (9) supporting said web in order to enclose the web (8) and the wire or felt (9) into contact with said surfaces, and means for heating the surface making contact with the web and means for cooling the surface making contact with the wire of felt (9), characterized in that the surface making contact with the wire or felt (9) is formed by the outer surface of a rotating metal cylinder (2) provided with internal cooling, and that the surface making contact with the web (8) is formed by a metal band (6) displaceable around the outer surface of the cooled cylinder (2) stationarily with respect to said outer cylinder surface and preheated outside of the drying zone, which band is pressed against the outer surface of the web (8) and the wire or felt (9) positioned on the cooled cylinder by means of an air-pressure chamber (16) provided outermost therein.

9. Device according to claim 8, wherein said metal band (6) is preheated outside of the drying zone by passing it around at least one internally heated cylinder (1, 3, 4, 5) with a metal mantle.

10. Device according to claim 9, wherein the mantle of at least one internally heated cylinder (1, 3, 4, 5) with a metal mantle is formed by metal profile tubes positioned close against each other in the direction of the cylinder axis.

* * * * *